US011215057B2

(12) United States Patent
Yoshida et al.

(10) Patent No.: US 11,215,057 B2
(45) Date of Patent: Jan. 4, 2022

(54) TURBINE WHEEL, TURBINE, AND TURBOCHARGER

(71) Applicant: MITSUBISHI HEAVY INDUSTRIES ENGINE & TURBOCHARGER, LTD., Sagamihara (JP)

(72) Inventors: Toyotaka Yoshida, Tokyo (JP); Yosuke Danmoto, Sagamihara (JP); Yoji Akiyama, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 259 days.

(21) Appl. No.: 16/342,357

(22) PCT Filed: Jan. 16, 2017

(86) PCT No.: PCT/JP2017/001276
§ 371 (c)(1),
(2) Date: Apr. 16, 2019

(87) PCT Pub. No.: WO2018/131167
PCT Pub. Date: Jul. 19, 2018

(65) Prior Publication Data

US 2019/0257204 A1 Aug. 22, 2019

(51) Int. Cl.

| | |
|---|---|
| ***F01D 5/14*** | (2006.01) |
| ***F01D 5/04*** | (2006.01) |
| ***F02B 39/00*** | (2006.01) |

(52) U.S. Cl.
CPC ..... *F01D 5/141* (2013.01); *F01D 5/048* (2013.01); *F02B 39/00* (2013.01);
(Continued)

(58) Field of Classification Search
CPC ... F01D 5/04; F01D 5/048; F01D 5/14; F01D 5/141; F01D 5/143; F01D 5/146;
(Continued)

(56) References Cited

U.S. PATENT DOCUMENTS 8,608,433 B2 12/2013 Lombard et al.
9,657,573 B2 5/2017 Higashimori
(Continued)

FOREIGN PATENT DOCUMENTS

CN 101915126 A 12/2010
DE 2048290 A1 4/1972
(Continued)

OTHER PUBLICATIONS

Office Action dated Dec. 24, 2019 issued in the corresponding Japanese Application No. 2018-561778 with a machine translation.
(Continued)

*Primary Examiner* — Woody A Lee, Jr.
*Assistant Examiner* — Justin A Pruitt
(74) *Attorney, Agent, or Firm* — Birch, Stewart, Kolasch & Birch, LLP.

(57) ABSTRACT

There is provided a turbine wheel includes a plurality of long blades and a plurality of short blades. A trailing edge of each short blade is positioned upstream of a trailing edge of each long blade in an axial direction of the turbine wheel, and at least one of a leading edge of each long blade or a leading edge of each short blade includes an inclined part which is inclined so that a distance to a rotational axis of the turbine wheel decreases toward a hub.

12 Claims, 11 Drawing Sheets

(52) U.S. Cl.
CPC ..... *F05D 2220/30* (2013.01); *F05D 2220/40* (2013.01); *F05D 2240/303* (2013.01)

(58) Field of Classification Search
CPC ..... F01D 5/147; F02B 37/00; F02B 39/00; F02C 6/12; F04D 25/04; F04D 25/045; F04D 29/242; F05D 2220/30; F05D 2220/40; F05D 2240/303
USPC ..... 416/203
See application file for complete search history.

(56) References Cited

U.S. PATENT DOCUMENTS

| | | | | |
|---|---|---|---|---|
| 2004/0105756 | A1 | 6/2004 | Higashimori et al. | |
| 2007/0231141 | A1 | 10/2007 | Chaing et al. | |
| 2010/0233504 | A1 | 9/2010 | Rice et al. | |
| 2017/0298737 | A1* | 10/2017 | Kuno ..... | F01D 5/048 |

FOREIGN PATENT DOCUMENTS

| | | | |
|---|---|---|---|
| DE | 102014220680 | A1 | 4/2016 |
| EP | 2 894 296 | A1 | 7/2015 |
| JP | 62-18397 | U | 2/1987 |
| JP | 8-109801 | A | 4/1996 |
| JP | 11-190201 | A | 7/1999 |
| JP | 2004-92498 | A | 3/2004 |
| WO | WO 2014/038054 | A1 | 3/2014 |

OTHER PUBLICATIONS

Office Action dated Jun. 30, 2020 issued in counterpart Japanese Application No. 2018-561778.

Extended European Search Report dated Aug. 2, 2019 issued in the corresponding European Application No. 17891043.6.

International Preliminary Report on Patentability and Written Opinion of the International Searching Authority dated Jul. 25, 2019, for International Application No. PCT/JP2017/001276, with an English Translation of the Written Opinion.

International Search Report, dated Mar. 21, 2017, for International Application No. PCT/JP2017/001276.

* cited by examiner

TURBINE WHEEL, TURBINE, AND TURBOCHARGER

TECHNICAL FIELD

The present disclosure relates to a turbine wheel, a turbine, and a turbocharger.

BACKGROUND ART

In recent years, turbochargers are used to improve the fuel efficiency, and the proportion of automobile engines equipped with a turbocharger increases. In particular, a variable geometry turbocharger, which is capable of changing flow rate characteristics by changing the nozzle opening degree, enables operation in accordance with load fluctuation of an engine and has an advantage in terms of response at low load of the engine.

Further, a gasoline engine equipped with a turbocharger increases in recent years, and the application of a variable geometry turbocharger progresses in view of the above property of the variable geometry turbocharger. As the engine outlet pressure (turbine inlet pressure) in an engine high-speed region increases, the pumping loss increases and the engine performance decreases. Accordingly, it is desired that the variable geometry turbocharger has high turbine flow rate and high turbine efficiency in the engine high-speed region (on the side with high nozzle opening degree).

Patent Document 1 discloses a turbine wheel including a plurality of long blades and a plurality of short blades, in which trailing edges of the short blades are positioned upstream of trailing edges of the long blades in the axial direction of the turbine wheel, and a turbocharger. This configuration increases a throat area formed adjacent to the trailing edges of the long blades to respond to an increase in the flow rate and optimizes the distance between blades on the inlet side to guide the flow. Thus, it is possible to suppress the reduction in efficiency while increasing the flow rate, and it is possible to achieve high efficiency over a wide flow rate range.

CITATION LIST

Patent Literature

Patent Document 1: U.S. Pat. No. 8,608,433B

SUMMARY

Problems to be Solved

The present inventors have keenly conducted studies and consequently found that the turbine wheel disclosed in Patent Document 1 is likely to have high incidence loss on the inlet hub side of the turbine wheel. The incidence loss is a loss caused by incidence (angle of attack), which is a difference between the flow angle of gas flowing into the leading edge of the blade and the blade angle at the leading edge. When the incidence increases, the inflow gas is separated at the leading edge, which increases the collision loss and increases the incidence loss.

In particular, the separated flow occurring on the inlet hub side of the turbine wheel moves toward the shroud and becomes a leakage flow (hereinafter, referred to as "clearance flow") which passes between the tip of the blade and the casing, which can prevent improvement in turbine efficiency.

At least one embodiment of the present invention was made in view of the above typical problem, and an object thereof is to provide a turbine wheel which enables high turbine efficiency and to provide a turbine and a turbocharger including the same.

Solution to the Problems (1) According to at least one embodiment of the present invention, a turbine wheel comprises a plurality of long blades and a plurality of short blades, a trailing edge of each short blade is positioned upstream of a trailing edge of each long blade in an axial direction of the turbine wheel, and at least one of a leading edge of each long blade or a leading edge of each short blade includes an inclined part which is inclined so that a distance to a rotational axis of the turbine wheel decreases toward a hub.

According to the turbine wheel described in the above configuration (1), since the short blades do not reach the axial directional positions of the trailing edges of the long blades, the area of a throat formed between the long blades at the trailing edges of the long blades is ensured, which makes it possible to respond to an increase in flow rate. Further, since the long blades and the short blades extend to the inlet side of the turbine wheel, the distance between blades is optimized on the inlet side of the turbine wheel, which makes it possible to rectify the flow. Thus, it is possible to suppress the reduction in efficiency while increasing the flow rate, and it is possible to achieve high efficiency over a wide flow rate range.

Additionally, compared to an embodiment where both the leading edge of the long blade and the leading edge of the short blade extend along the axial direction, the provision of at least one of the inclined parts improves the incidence of at least one of the long blade or the short blade on the hub side, thereby controlling the separation at at least one of the leading edge of the long blade or the leading edge of the short blade on the hub side. Thus, it is possible to suppress the clearance flow caused by the separation, and it is possible to achieve high turbine efficiency.

(2) In some embodiments, in the turbine wheel described in the above (1), the leading edge of each long blade and the leading edge of each short blade each include the inclined part which is inclined so that the distance to the rotational axis of the turbine wheel decreases toward the hub.

According to the turbine wheel described in the above (2), since the inclined part is disposed on each of the leading edge of the long blade and the leading edge of the short blade, it is possible to improve the incidence of both the long blade and the short blade on the hub side, and thus it is possible to control the separation at both the leading edge of the long blade and the leading edge of the short blade on the hub side. Thus, it is possible to suppress the clearance flow caused by the separation, and it is possible to achieve high turbine efficiency. Further, the provision of the inclined part to each of the leading edge of the long blade and the leading edge of the short blade reduces the inertia moment of the turbine wheel. Thus, it is possible to improve the turbo lag.

(3) In some embodiments, in the turbine wheel described in the above (1) or (2), when X1 is an intersection between the leading edge of each short blade and a middle span line formed by a set of middle positions in a span direction of the short blade, R1 is a distance between the intersection X1 and the rotational axis of the turbine wheel, R0 is an outer diameter of the turbine wheel, and D is a distance between the leading edge of the short blade and the trailing edge of the short blade along the middle span line, the following expression (A) is satisfied:

$$(R0-R1+D)/(R0-R1)>12.5 \quad (A)$$

According to the turbine wheel described in the above (3), since the inclined part is disposed on each of the leading edge of the long blade and the leading edge of the short blade, the inertia moment of the turbine wheel is reduced, but, on the other hand, an area receiving the load is likely to decrease in each blade. Accordingly, the short blade is configured to satisfy the above expression (A), so that the position of the trailing edge of the short blade is shifted more downstream than the typical position of that to ensure the area receiving the load. Thereby, it is possible to suppress the reduction in torque output while reducing the inertia moment of the turbine wheel.

(4) In some embodiments, in the turbine wheel described in the above (1), the leading edge of each long blade includes the inclined part which is inclined so that the distance to the rotational axis of the turbine wheel decreases toward the hub, and at least a part of the leading edge of each short blade is positioned on an outer side of the inclined part in a radial direction of the turbine wheel.

According to the turbine wheel described in the above (4), since the inclined part is disposed on the leading edge of the long blade, it is possible to improve the incidence of the long blade on the hub side, and thus it is possible to control the separation at the leading edge of the long blade on the hub side. Thus, it is possible to suppress the clearance flow caused by the separation, and it is possible to achieve high turbine efficiency.

Further, since at least a part of the leading edge of the short blade is positioned on the outer side of the inclined part in the radial direction, it is possible to improve the incidence of the long blade having longer width, while increasing the area receiving the load in the short blade having shorter length as much as possible. Thus, it is possible to reduce the incidence loss while the suppressing reduction in torque output, and it is possible to achieve high turbine efficiency.

(5) In some embodiments, in the turbine wheel described in the above (4), the leading edge of each short blade extends along the axial direction.

According to the turbine wheel described in the above (5), since the inclined part is disposed on the leading edge of the long blade, it is possible to reduce the inertia moment of the turbine wheel, compared with an embodiment where both the leading edge of the long blade and the leading edge of the short blade extend along the axial direction. Thus, it is possible to improve the turbo lag.

(6) In some embodiments, in the turbine wheel described in the above (1), the leading edge of each short blade includes the inclined part which is inclined so that the distance to the rotational axis of the turbine wheel decreases upstream in the axial direction, and at least a part of the inclined part is positioned on an outer side of the leading edge of each long blade in a radial direction of the turbine wheel.

According to the turbine wheel described in the above (6), since the inclined part is disposed on the leading edge of the short blade, it is possible to improve the incidence of the short blade on the hub side, and thus it is possible to control the separation at the leading edge of the short blade on the hub side. Thus, it is possible to suppress the clearance flow caused by the separation, and it is possible to achieve high turbine efficiency.

Further, since at least a part of the inclined part of the leading edge of the short blade is positioned on the outer side of the leading edge of the long blade in the radial direction, it is possible to improve the incidence of the long blade having longer width, while increasing the area receiving the load in the short blade having shorter length as much as possible. Thus, it is possible to reduce the incidence loss while suppressing the reduction in torque output, and it is possible to achieve high turbine efficiency.

(7) In some embodiments, in the turbine wheel described in the above (6), the leading edge of each long blade extends along the axial direction.

According to the turbine wheel described in the above (7), since the inclined part is disposed on the leading edge of the short blade, it is possible to reduce the inertia moment of the turbine wheel, compared with an embodiment where both the leading edge of the long blade and the leading edge of the short blade extend along the axial direction. Thus, it is possible to improve the turbo lag.

(8) A turbine according to at least one embodiment of the present invention comprises a turbine wheel described in any one of the above (1) to (7).

According to the turbine described in the above (8), since the turbine wheel described in any one of the above (1) to (7) is included, it is possible to achieve high turbine efficiency.

(9) A turbocharger according to at least one embodiment of the present invention comprises a turbine described in the above (8).

According to the turbocharger described in the above (9), since the turbine described in above (8) is included, it is possible to achieve high efficiency.

Advantageous Effects

According to at least one embodiment of the present invention, there is provided a turbine wheel which enables high turbine efficiency, and a turbine and a turbocharger including the same.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
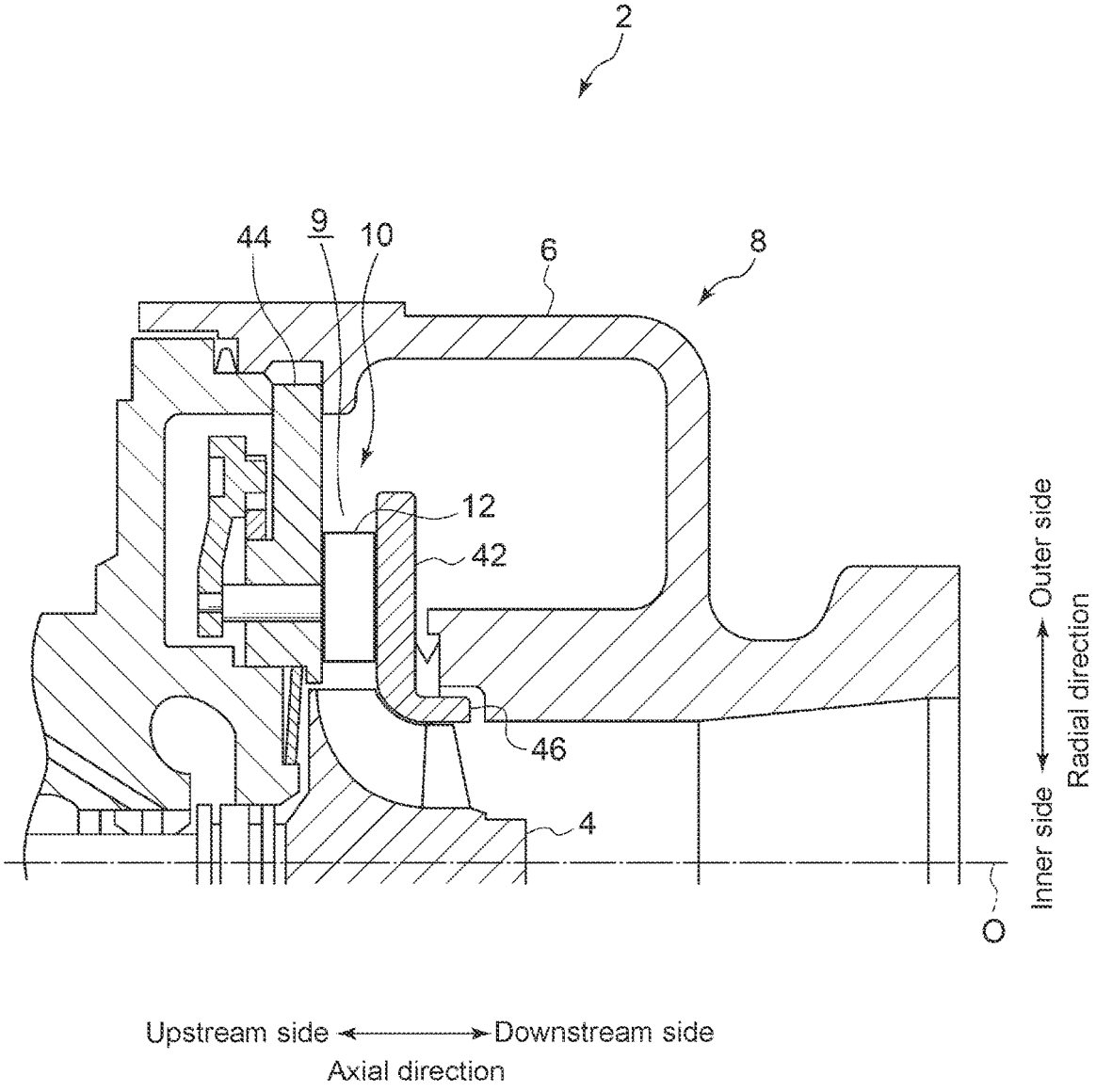
FIG. 1 is a schematic meridional view illustrating a partial configuration of a turbine 2 in a turbocharger according to an embodiment.

FIG. 1 is a schematic meridional view illustrating a partial configuration of a turbine 2 in a turbocharger according to an embodiment. A turbocharger is, for instance, applied to a vehicle, a ship, or the like.

As shown in FIG. 1, the turbine 2 includes a turbine wheel 4, a turbine housing 8 accommodating the turbine wheel 4 and forming a scroll part 6, and a variable nozzle mechanism 10.

The variable nozzle mechanism 10 includes a nozzle plate 42, a nozzle mount 44, an exhaust gas passage 9 which is formed between the nozzle mount 44 and the nozzle plate 42 and through which exhaust gas is introduced from the scroll part 6 to the turbine wheel 4, and a nozzle vane 12 rotatably supported to the nozzle mount 44 and capable of changing a passage area of the exhaust gas passage 9. The variable nozzle mechanism 10 is configured to change the passage area of the exhaust gas passage 9 by rotation of the nozzle vane 12 to adjust the flow velocity of exhaust gas to the turbine wheel 4. In the illustrated exemplary embodiment, a part of the nozzle plate 42 functions as a casing 46 surrounding the turbine wheel 4.

Figure 2:
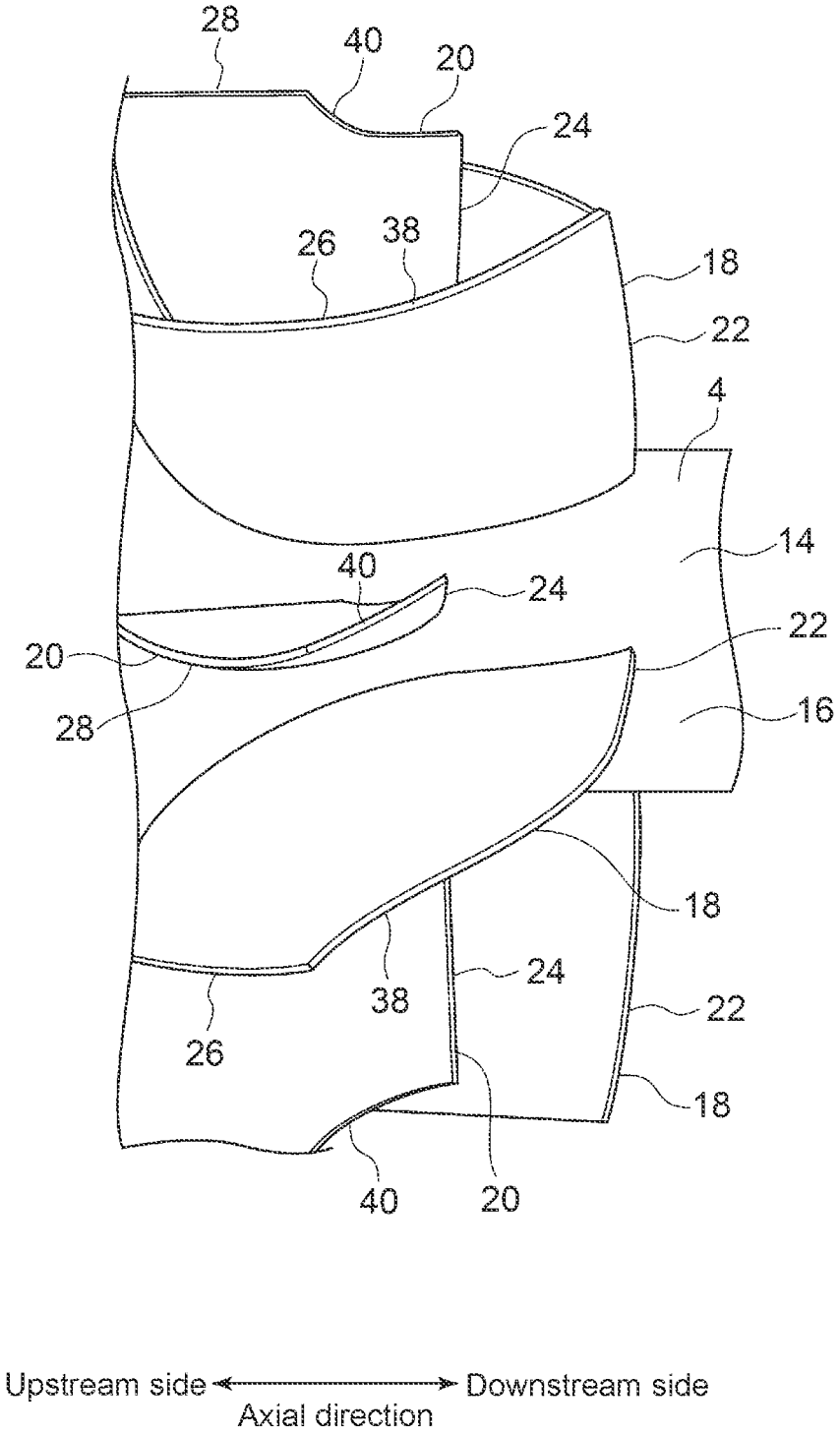
FIG. 2 is a schematic perspective view illustrating a configuration of a turbine wheel 4 according to an embodiment.

FIG. 2 is a schematic perspective view illustrating a configuration of a turbine wheel 4 according to an embodiment. Hereinafter, the axial direction of the turbine wheel 4 is referred to as merely "axial direction", and the radial direction of the turbine wheel 4 is referred to as merely "radial direction", and the circumferential direction of the turbine wheel 4 is referred to as merely "circumferential direction".

As shown in FIG. 2, the turbine wheel 4 includes a hub 14, a plurality of long blades 18 disposed on an outer peripheral surface 16 of the hub 14, a plurality of short blades 20 disposed on the outer peripheral surface 16 of the hub 14, in which the short blades 20 each have a length smaller than the length of the long blades 18.

The long blades 18 are arranged at intervals in the circumferential direction. The short blades 20 are arranged at intervals in the circumferential direction. Each of the short blades 20 is disposed between two adjacent long blades 18. In the illustrated exemplary embodiment, the same number of the long blades 18 and the short blades 20 are arranged alternately.

As shown in FIG. 2, a trailing edge 24 of the short blade 20 is positioned upstream of a trailing edge 22 of the long blade 18 in the axial direction. With the above configuration, since the short blades 20 do not reach the axial directional positions of the trailing edges 22 of the long blades 18, the area of a throat formed between the long blades 18 at the trailing edges 22 of the long blades 18 increases, which makes it possible to respond to an increase in flow rate. Further, since the long blades 18 and the short blades 20 extend to the inlet side of the turbine wheel 4, the distance between blades is optimized on the inlet side of the turbine wheel 4, which makes it possible to rectify the flow. Thus, it is possible to suppress the reduction in efficiency while increasing the flow rate, and it is possible to achieve high efficiency over a wide flow rate range.

Figure 3:
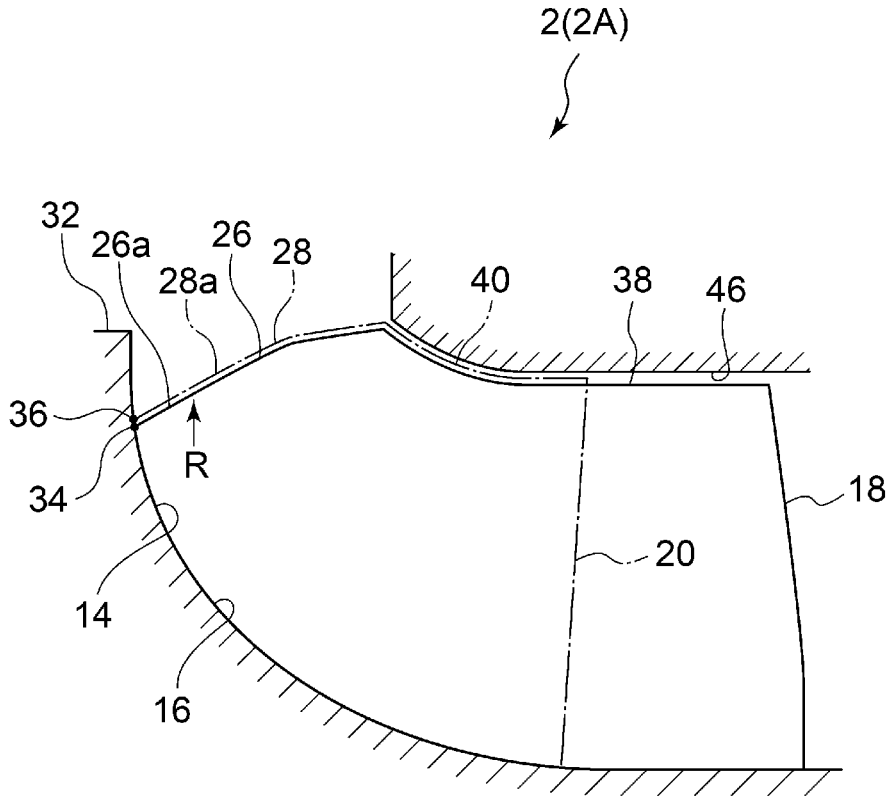
FIG. 3 is a schematic meridional view illustrating a partial configuration of a turbine 2(2A) according to an embodiment.
Figure 4:
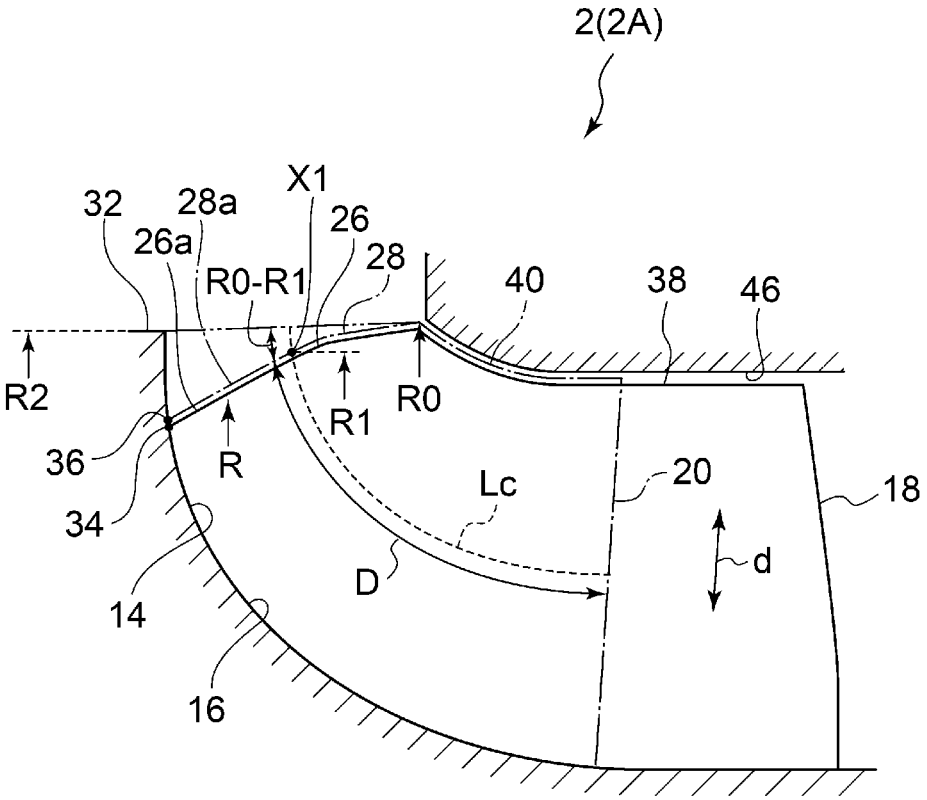
FIG. 4 is a schematic meridional view illustrating a partial configuration of a turbine 2(2A) according to an embodiment.
Figure 5:
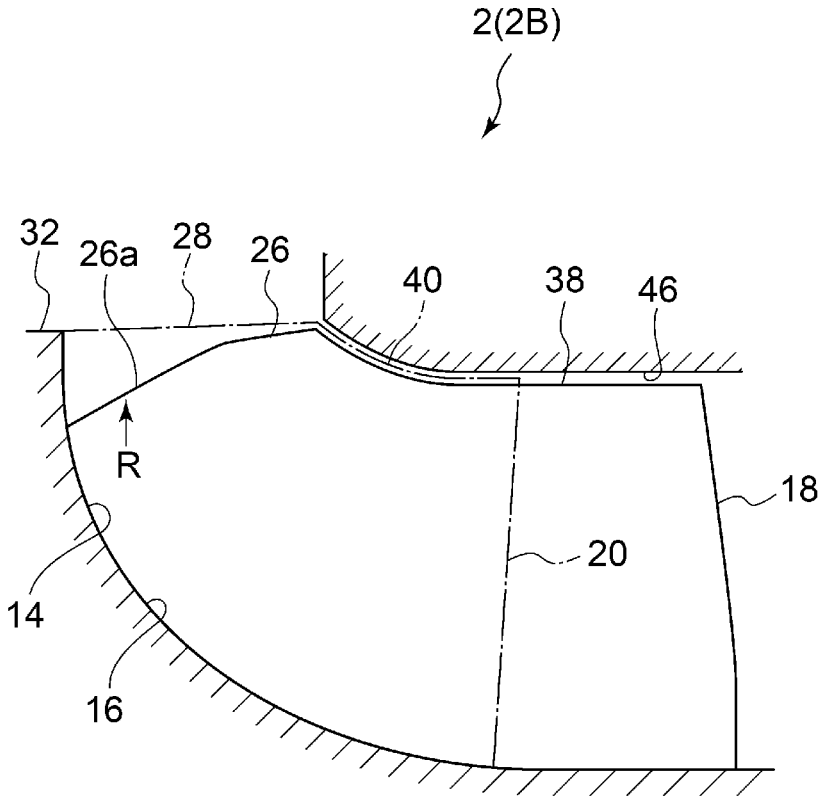
FIG. 5 is a schematic meridional view illustrating a partial configuration of a turbine 2(2B) according to an embodiment.
Figure 6:
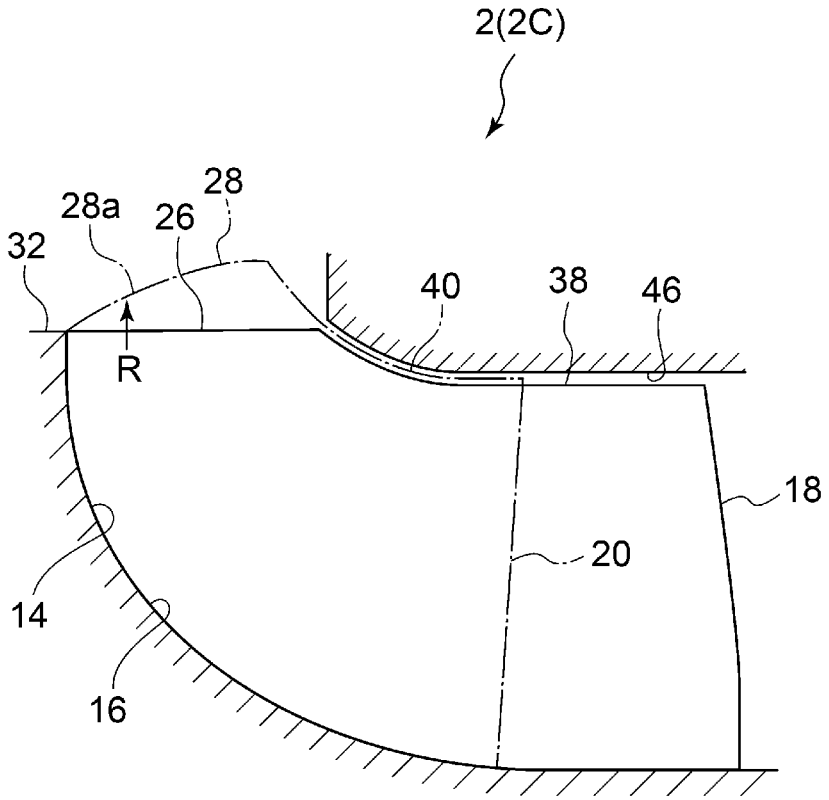
FIG. 6 is a schematic meridional view illustrating a partial configuration of a turbine 2(2C) according to an embodiment.
Figure 7:
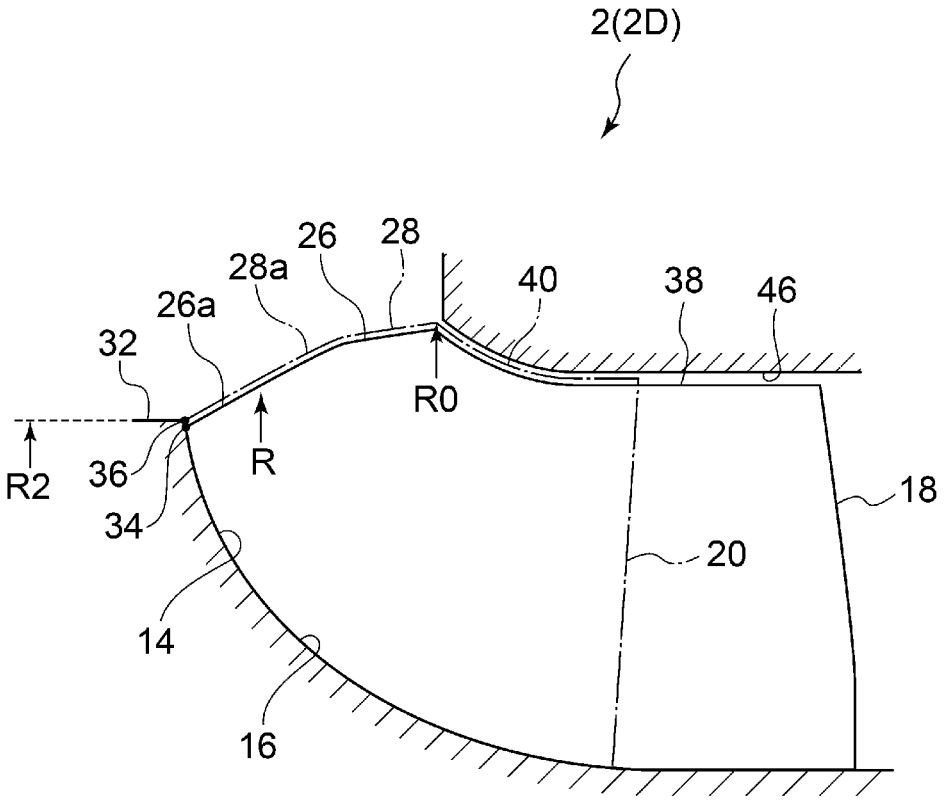
FIG. 7 is a schematic meridional view illustrating a partial configuration of a turbine 2(2D) according to an embodiment.
Figure 8:
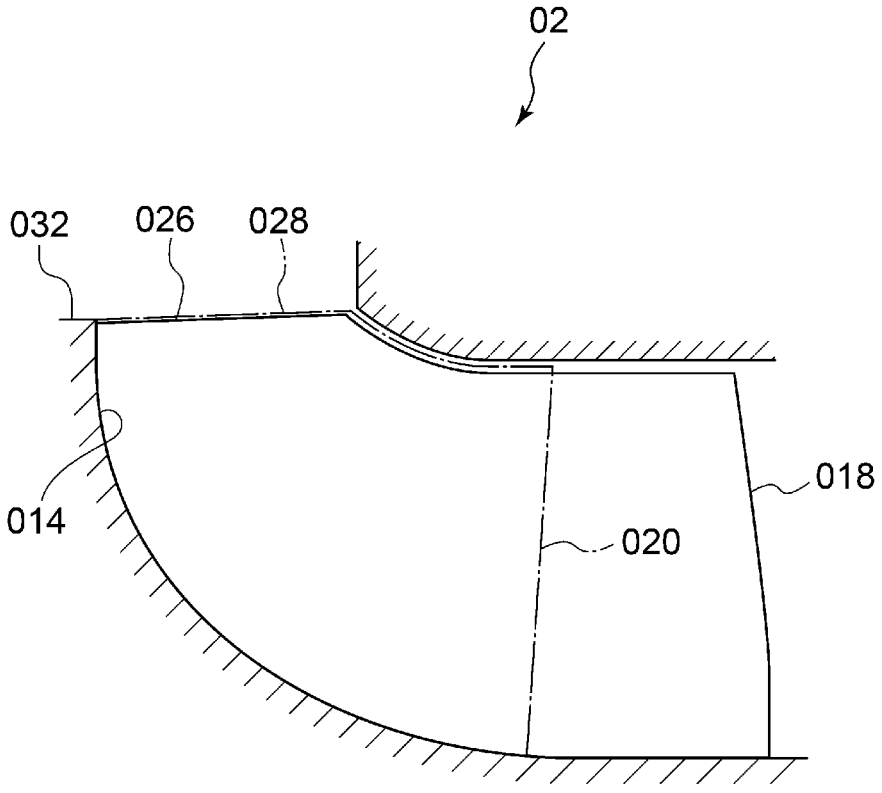
FIG. 8 is a schematic meridional view illustrating a partial configuration of a turbine 02 according to a comparative embodiment.

FIG. 3 is a schematic meridional view illustrating a partial configuration of a turbine 2(2A) according to an embodiment. FIG. 4 is a schematic meridional view illustrating a partial configuration of a turbine 2(2A) according to an embodiment. FIG. 5 is a schematic meridional view illustrating a partial configuration of a turbine 2(2B) according to an embodiment. FIG. 6 is a schematic meridional view illustrating a partial configuration of a turbine 2(2C) according to an embodiment. FIG. 7 is a schematic meridional view illustrating a partial configuration of a turbine 2(2D) according to an embodiment. FIG. 8 is a schematic meridional view illustrating a partial configuration of a turbine 02 according to a comparative embodiment. In FIGS. 3 to 7, the meridional shape of the long blade 18 is shown by the solid line, and the meridional shape of the short blade 20 is shown by the long dashed dotted line. In FIG. 8, the meridional shape of the long blade 018 is shown by the solid line, and the meridional shape of the short blade 020 is shown by the long dashed dotted line.

In some embodiments, for instance as shown in FIGS. 3 to 7, at least one of a leading edge 26 of the long blade 18 or a leading edge 28 of the short blade 20 includes an inclined part 26*a*, 28*a* which is inclined so that a distance R to a rotational axis O of the turbine wheel 4 decreases toward the hub 14.

With the above configuration, compared to the embodiment shown in FIG. 8 where both the leading edge 026 of the long blade 018 and the leading edge 028 of the short blade 020 extend along the axial direction from the outer peripheral end 032 of the hub 014, the provision of at least one of the inclined parts 26*a*, 28*a* improves the incidence of at least one of the long blade 18 or the short blade 20 on the hub 14 side, thereby controlling the separation at at least one of the leading edge 26 of the long blade 18 or the leading edge 28 of the short blade 20 on the hub 14 side. Thus, it is possible to suppress the clearance flow at at least one of a tip 38 of the long blade 18 or a tip 40 of the short blade 20, and it is possible to achieve high turbine efficiency.

In some embodiments, for instance as shown in FIGS. 3 and 4, the leading edge 26 of the long blade 18 includes the inclined part 26*a* which is inclined so that the distance R to the rotational axis O (see FIG. 1) of the turbine wheel 4 decreases toward the hub 14, and the leading edge 28 of the short blade 20 includes the inclined part 28*a* which is inclined so that the distance R to the rotational axis O of the turbine wheel 4 decreases toward the hub 14. In the embodiment shown in FIGS. 3 and 4, the inclined part 26*a* is disposed so that a hub-side end 34 of the leading edge 26 of the long blade 18 is positioned on the inner side of an outer peripheral end 32 of the hub 14 in the radial direction, and the inclined part 28*a* is disposed so that a hub-side end 36 of the leading edge 28 of the short blade 20 is positioned on the inner side of the outer peripheral end 32 of the hub 14 in the radial direction.

With the above configuration, compared to the embodiment shown in FIG. 8, the provision of the inclined part 26*a* and the inclined part 28*a* improves the incidence of both the long blade 18 and the short blade 20 on the hub 14 side, thereby controlling the separation at both the leading edge 26 of the long blade 18 and the leading edge 28 of the short blade 20 on the hub 14 side. Thus, it is possible to suppress the clearance flow caused by the separation, and it is possible to achieve high turbine efficiency.

Further, with the above configuration, compared to the embodiment shown in FIG. 8, the provision of the inclined part 26*a* and the inclined part 28*a* reduces the inertia moment of the turbine wheel 4. Thus, it is possible to improve the turbo lag.

In some embodiments, for instance as shown in FIG. 4, when X1 is an intersection between the leading edge 28 of the short blade 20 and a middle span line Lc formed by a set of middle positions in a span direction d of the short blade 20, R1 is a distance between the intersection X1 and the rotational axis O of the turbine wheel 4, R0 is an outer diameter of the turbine wheel 4, and D is a distance between the leading edge 28 of the short blade 20 and the trailing edge 24 of the short blade 20 along the middle span line Lc, the following expression (A) is satisfied: $(R0-R1+D)/(R0-R1)>12.5$ (A)

In the exemplary embodiment shown in FIG. 4, the outer diameter R0 of the turbine wheel 4 corresponds to a distance between the leading edge 26 of the long blade 18 and the rotational axis O of the turbine wheel 4, and corresponds to the distance between the leading edge 28 of the short blade 20 and the rotational axis O of the turbine wheel 4, and corresponds to the outer diameter R2 of the hub 14.

In the embodiment shown in FIG. 4, compared to the embodiment shown in FIG. 8, since the inclined part 26*a* or the inclined part 28*a* is disposed on each of the leading edge 26 of the long blade 18 and the leading edge 28 of the short blade 20, the inertia moment of the turbine wheel 4 is reduced, but, on the other hand, an area receiving the load is likely to decrease in each blade 18, 20. Accordingly, the short blade 20 is configured to satisfy the above expression (A), so that the position of the trailing edge 24 of the short blade 20 is shifted more downstream than the typical position of that to ensure the area receiving the load. Thereby, it is possible to suppress the reduction in torque output while reducing the inertia moment of the turbine wheel 4.

In some embodiments, for instance as shown in FIG. 5, the leading edge 26 of the long blade 18 includes the inclined part 26*a* which is inclined so that the distance R to the rotational axis O of the turbine wheel 4 decreases toward the hub 14, and at least a part of (preferably the whole of) the leading edge 28 of the short blade 20 is positioned on the outer side of the inclined part 26*a* in the radial direction. Further, in the turbine wheel 4 shown in FIG. 5, the leading edge 28 of the short blade 20 extends along the axial direction from the outer peripheral end 32 of the hub 14.

With the above configuration, compared to the embodiment shown in FIG. 8, the provision of the inclined part 26*a* improves the incidence of the long blade 18 on the hub 14 side, thereby controlling the separation at the leading edge 26 of the long blade 18 on the hub 14 side. Thus, it is possible to suppress the clearance flow caused by the separation, and it is possible to achieve high turbine efficiency. Further, since the inertia moment of the turbine wheel 4 is reduced, it is possible to improve the turbo lag.

Further, since at least a part of the leading edge 28 of the short blade 20 is positioned on the outer side of the inclined part 26*a* in the radial direction, it is possible to improve the incidence of the long blade 18 having longer width, while increasing the area receiving the load in the short blade 20 having shorter length as much as possible. Thus, it is possible to reduce the incidence loss while suppressing the reduction in torque output, and it is possible to achieve high turbine efficiency.

In some embodiments, for instance as shown in FIG. 6, the leading edge 28 of the short blade 20 includes the inclined part 28*a* which is inclined so that the distance R to the rotational axis O of the turbine wheel 4 decreases upstream in the axial direction, and at least a part of the inclined part 28*a* is positioned on the outer side of the leading edge 26 of the long blade 18 in the radial direction. Further, in the turbine wheel 4 shown in FIG. 6, the leading edge 26 of the long blade 18 extends along the axial direction from the outer peripheral end 32 of the hub 14.

With the above configuration, compared to the embodiment shown in FIG. 8, the provision of the inclined part 28*a* improves the incidence of the short blade 20 on the hub 14 side, thereby controlling the separation at the leading edge 28 of the short blade 20 on the hub 14 side. Thus, it is possible to suppress the clearance flow caused by the separation, and it is possible to achieve high turbine efficiency.

Further, since at least a part of the inclined part 28*a* of the leading edge 28 of the short blade 20 is positioned on the outer side of the leading edge 26 of the long blade 18 in the radial direction, it is possible to improve the incidence of the long blade 18 having longer width, while increasing the area receiving the load in the short blade 20 having shorter length as much as possible. Thus, it is possible to reduce the incidence loss while suppressing the reduction in torque output, and it is possible to achieve high turbine efficiency.

In some embodiments, for instance as shown in FIG. 7, the outer diameter R2 of the hub 14 is smaller than the outer diameter R0 of the turbine wheel 4. In the illustrated exemplary embodiment, the outer diameter R2 of the hub 14 is set so as to match with the position of the hub-side end 34 of the leading edge 26 of the long blade 18 and the position of the hub-side end 36 of the leading edge 28 of the short blade 20. With the above configuration, compared to the embodiment shown in FIG. 3, it is possible to reduce the inertia moment of the turbine wheel 4.

Figure 9:
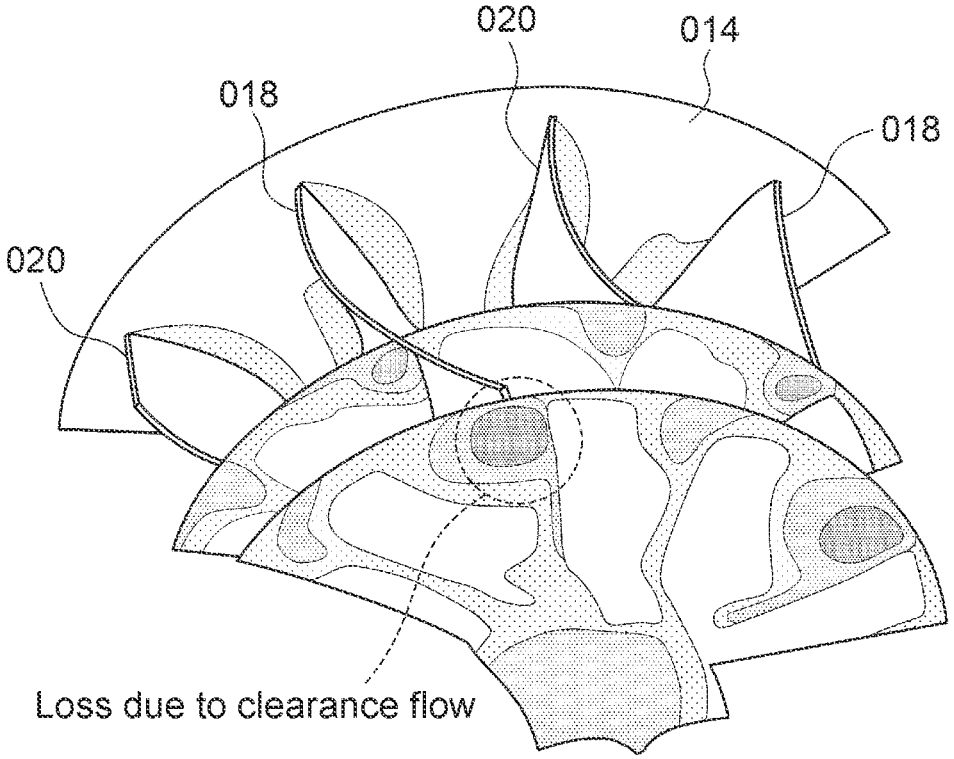
FIG. 9 is a diagram showing an example of distribution of loss in a turbine 02 according to a comparative embodiment shown in FIG. 8.
Figure 10:
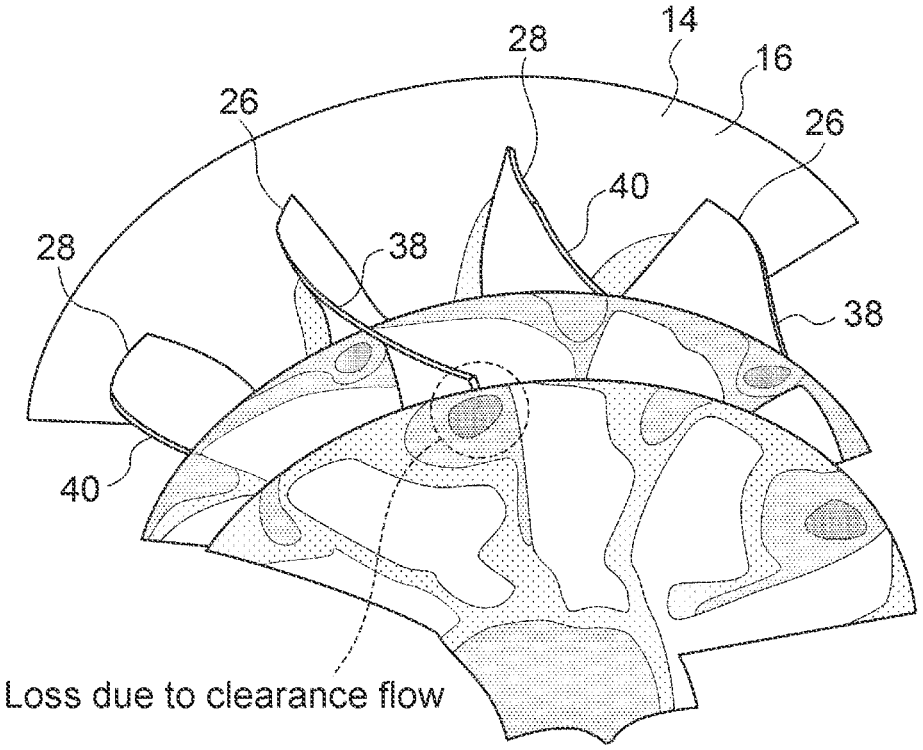
FIG. 10 is a diagram showing an example of distribution of loss in a turbine 2 according to an embodiment.
Figure 11:
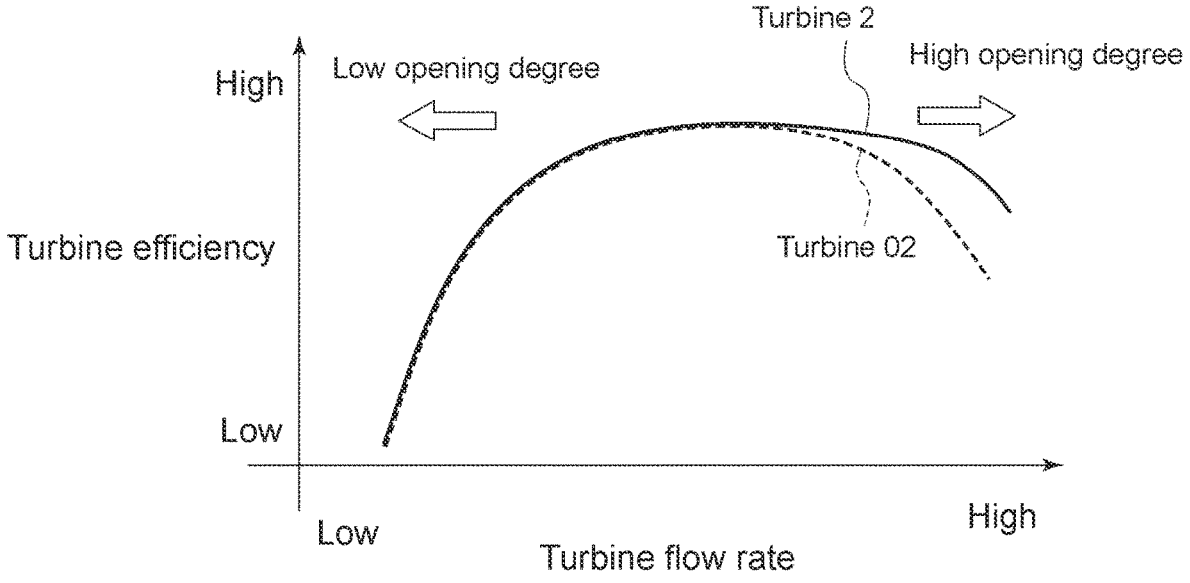
FIG. 11 is a diagram showing an example of characteristic curve which shows a relationship between the turbine flow rate and the turbine efficiency in the turbine 02 according to the comparative embodiment and in the turbine 2 according to the embodiment.

FIG. 9 is a diagram showing an example of distribution of loss in the turbine 02 according to the comparative embodiment shown in FIG. 8. FIG. 10 is a diagram showing an example of distribution of loss in the turbine 2 according to an embodiment. FIG. 11 is a diagram showing an example of characteristic curve which shows a relationship between the turbine flow rate and the turbine efficiency in the turbine 02 and in the turbine 2.

As shown in FIGS. 9 and 10, in the turbine 2 according to some embodiments, compared with the embodiment shown in FIG. 8, since the separation is suppressed at at least one of the leading edge 26 of the long blade 18 or the leading edge 28 of the short blade 20 on the hub 14 side, it is possible to reduce loss due to the clearance flow at at least one of the tip 38 of the long blade 18 or the tip 40 of the short blade 20. Thus, as shown in FIG. 11, it is possible to achieve high turbine efficiency particularly on the side where the nozzle vane 12 has high opening degree.

Embodiments of the present invention were described in detail above, but the present invention is not limited thereto, and various amendments and modifications may be implemented.

For instance, while in the exemplary embodiment shown in FIG. 2, the same number of the long blades 18 and the short blades 20 are alternately arranged in the circumferential direction, the number of the long blades 18 may be different from the number of the short blades 20. For instance, a plurality of short blades 20 may be disposed between two adjacent long blades 18.

REFERENCE SIGNS LIST

2 Turbine
4 Turbine wheel
6 Scroll part
8 Turbine housing
9 Exhaust gas passage
10 Variable nozzle mechanism
12 Nozzle vane
14 Hub
16 Outer peripheral surface
18 Long blade
20 Short blade
22, 24 Trailing edge
26, 28 Leading edge
26*a*, 28*a* Inclined part
32 Outer peripheral end
34, 36 Hub-side end
38, 40 Tip
42 Nozzle plate
44 Nozzle mount
46 Casing

The invention claimed is:

1. A turbine wheel comprising a plurality of long blades and a plurality of short blades, wherein a trailing edge of each short blade is positioned upstream of a trailing edge of each long blade in an axial direction of the turbine wheel, and wherein at least one of a leading edge of each long blade or a leading edge of each short blade includes an inclined part which is inclined so that a distance to a rotational axis of the turbine wheel decreases toward a hub, wherein the inclined part includes a first inclined part formed on the leading edge of each long blade, the first inclined part being inclined so that the distance to the rotational axis of the turbine wheel decreases toward the hub, and wherein at least a part of the leading edge of each short blade is positioned on an outer side of the first inclined part in a radial direction of the turbine wheel.

2. The turbine wheel according to claim 1, wherein the leading edge of each long blade and the leading edge of each short blade each include the inclined part which is inclined so that the distance to the rotational axis of the turbine wheel decreases toward the hub.

3. The turbine wheel according to claim 1, wherein, when X1 is an intersection between the leading edge of each short blade and a middle span line formed by a set of middle positions in a span direction of the short blade, R1 is a distance between the intersection X1 and the rotational axis of the turbine wheel, R0 is an outer diameter of the turbine wheel, and D is a distance between the leading edge of the short blade and the trailing edge of the short blade along the middle span line, the following expression (A) is satisfied:

$$(R0-R1+D)/(R0-R1)>12.5 \quad \text{(A)}.$$

4. The turbine wheel according to claim 1, wherein the leading edge of each short blade extends along the axial direction.

5. A turbine wheel comprising a plurality of long blades and a plurality of short blades, wherein a trailing edge of each short blade is positioned upstream of a trailing edge of each long blade in an axial direction of the turbine wheel, and wherein at least one of a leading edge of each long blade or a leading edge of each short blade includes an inclined part which is inclined so that a distance to a rotational axis of the turbine wheel decreases toward a hub, wherein the inclined part includes a second inclined part formed on the leading edge of each short blade, the second inclined part being inclined so that the distance to the rotational axis of the turbine wheel decreases upstream in the axial direction, and wherein at least a part of the second inclined part is positioned on an outer side of the leading edge of each long blade in a radial direction of the turbine wheel.

6. The turbine wheel according to claim 5, wherein the leading edge of each long blade extends along the axial direction.

7. A turbine comp sing a turbine wheel according to claim 1.

8. A turbocharger comprising a turbine according to claim 7.

9. The turbine wheel according to claim 5, wherein the leading edge of each long blade and the leading edge of each short blade each include the inclined part which is inclined so that the distance to the rotational axis of the turbine wheel decreases toward the hub.

10. The turbine wheel according to claim 5, wherein, when X1 is an intersection between the leading edge of each short blade and a middle span line formed by a set of middle positions in a span direction of the short blade, R1 is a distance between the intersection X1 and the rotational axis of the turbine wheel, R0 is an outer diameter of the turbine wheel, and D is a distance between the leading edge of the short blade and the trailing edge of the short blade along the middle span line, the following expression (A) is satisfied:

$$(R0-R1+D)/(R0-R1)>12.5 \quad \text{(A)}.$$

11. A turbine comprising a turbine wheel according to claim 5.

12. A turbocharger comprising a turbine according to claim 11.

* * * * *